United States Patent [19]

Griggs

[11] 4,316,342

[45] Feb. 23, 1982

[54] RECOIL ABSORBER AND REDIRECTOR MECHANISM FOR GUN STOCK

[76] Inventor: Jay P. Griggs, 515 N. Bridge St., Twin Bridges, Mont. 59754

[21] Appl. No.: 144,426

[22] Filed: Apr. 28, 1980

[51] Int. Cl.[3] ..... F41C 23/00

[52] U.S. Cl. ..... 42/74

[58] Field of Search ..... 42/74, 73

[56] References Cited

U.S. PATENT DOCUMENTS

| | | | |
|---|---|---|---|
| 169,465 | 11/1875 | Miller | 42/74 |
| 1,088,362 | 2/1914 | Perkins | 42/73 |
| 1,468,354 | 9/1923 | Caretto | 42/73 |
| 1,480,350 | 1/1924 | Martin et al. | 42/73 |
| 2,453,394 | 11/1948 | Wittman | 42/73 |
| 2,787,855 | 4/1957 | Guymon | 42/73 |
| 3,207,496 | 9/1965 | Hrebicek | 42/74 |
| 3,388,494 | 6/1968 | Kimball | 42/74 |
| 3,754,344 | 8/1973 | Spiliotis | 42/74 |

*Primary Examiner*—Charles T. Jordan

*Attorney, Agent, or Firm*—Warren F. B. Lindsley

[57] ABSTRACT

A recoil absorber and redirector mechanism for a shoulder held gun stock which reduces the effects of recoil by causing one of two normally aligned members mounted on the butt end of a gun stock to move laterally of the other under recoil thereby redirecting the forces of recoil with the movable member resiliently absorbing most of the recoil energy which is later used to reset the mechanism to its normal inactive position.

13 Claims, 9 Drawing Figures

RECOIL ABSORBER AND REDIRECTOR MECHANISM FOR GUN STOCK

BACKGROUND OF THE INVENTION

This invention relates to recoil absorber and redirector mechanisms for shoulder supported firearms such as rifles and shotguns, and more particularly, to an improvement in or attachment to the gun stock to substantially reduce and redirect both the recoil energy and the tendency of the gun to move upward or jerk when it is fired.

It is commonly known that the recoil of a gun causes the barrel to shift in a generally upward direction and to the left. In an automatic gun which is firing rapidly, this becomes a force which is practically uncontrollable so that effective use of the weapon is not always possible after the first few shots when rapid firing is being used.

DESCRIPTION OF THE PRIOR ART

Although the prior art has attenpted to reduce recoil of shoulder supported firearms with various gun stock mounted devices, none have been totally satisfactory and particularly economical to manufacture.

U.S. Pat. No. 169,465 discloses a recoil check for gun stocks employing a hinge guided, spring actuated check plate.

U.S. Pat. No. 1,088,362 discloses an adjustable butt plate for gun stocks, the plate of which is positioned relative to the gun stock for a given user of the firearm and then fixedly bolted in position.

U.S. Pat. Nos. 1,468,354 and 2,453,394 provide recoil absorbers capable of universal movement between the shoulder engaging portion and the gun stock.

U.S. Pat. No. 1,480,350 discloses a gun employing a shoulder pad which is pivoted thereto on a transverse pivot located back of the stock of the gun with means disposed on opposite sides of the pivot for adjusting the pad with respect to the stock and retaining the pad in the adjusted position.

U.S. Pat. No. 2,787,855 discloses an adjustable butt plate which may be displaced vertically and bolted in that position.

U.S. No. 3,207,496 discloses a recoil mechanism employing a variable rate spring mechanism and associated cams providing reciprocable action between the relatively movable parts of a gun stock mechanism.

U.S. Pat. No. 3,388,494 discloses a gun stock comprising two pivotal sections which respond by pivotal action to the recoil of a shot.

U.S. Pat. No. 3,754,344 discloses a gun recoil absorber employing spring tensioned lever actuated means anchored within a cavity in the gun stock. The mechanism is adapted to reciprocate in an axial direction and is operatively associated with a hollow movable end member conforming to the shape and dimensions of an adjacent conventional wooden gun stock.

SUMMARY OF THE INVENTION

In accordance with the present invention, a recoil-redirector absorber mechanism is disclosed comprising two interconnected parts which may move relative to one another under recoil action and wherein a spring is provided to bias the parts to their normal juxtapositioned arrangement and to absorb the forces of recoil under shell explosion reaction.

It is, therefore, one object of this invention to provide an improved mechanism for the end of a gun stock of a shoulder held firearm which reduces to a minimum recoil.

Another object of this invention is to provide an improved gun stock which not only reduces to a very minimum the change of position of the muzzle of the gun in continued firing, but also relieves the shock against the shoulder of the gunner making it possible for him to maintain a stable position with a well aimed firearm under rapid firing conditions.

A further object of this invention is to provide a recoil mechanism for shoulder held firearms in which the force of recoil is directed away from the shoulder of the gunner and absorbed by a suitable shock absorbing means.

A still further object of this invention is to provide an improved recoil mechanism for applying to the end of the gun stock of a shoulder held firearm wherein the gun stock moves relative to a shoulder held attachment under recoil with the recoil absorbed by a shock absorbing means which shock absorbing means after absorbing the recoil forces uses this absorbed force to return the gun stock to its normal shoulder held position.

Another object of this invention is to provide a recoil control device for a gun stock which is readily adjustable depending on the ammunition used and the needs of a particular operator.

It is a further object of the invention to provide a fully automatic, shoulder held device for firearms which dampens recoil through absorption of the energy to substantially reduce disturbance of the gunner and the gun attitude.

Other objects and features of the invention relating to details of construction and operation will be apparent in the following description and claims.

BRIEF DESCRIPTION OF THE DRAWING

The present invention may be more readily described by reference to the accompanying drawing in which.

DESCRIPTION OF THE PREFERRED EMBODIMENT

Figure 1:
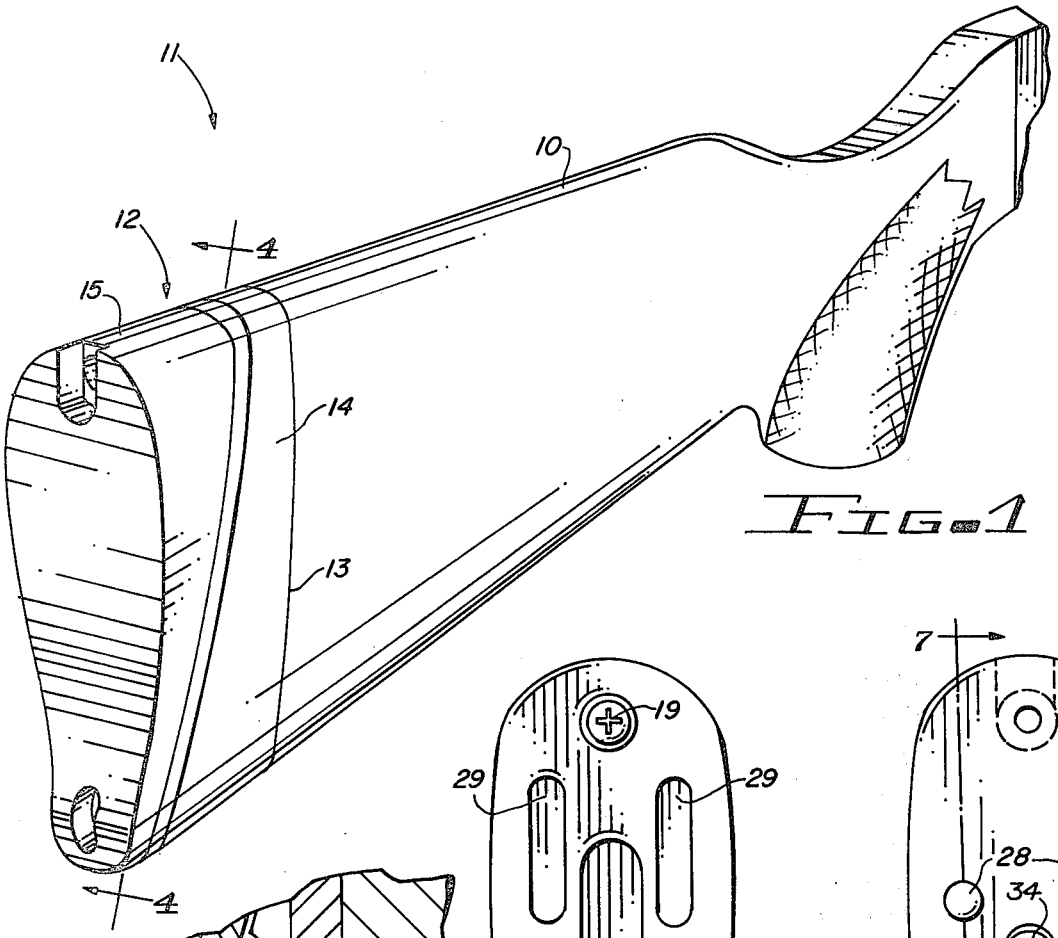
FIG. 1 is a partial perspective view of the gun stock end of a shoulder held firearm and embodying the invention.
Figure 4A:
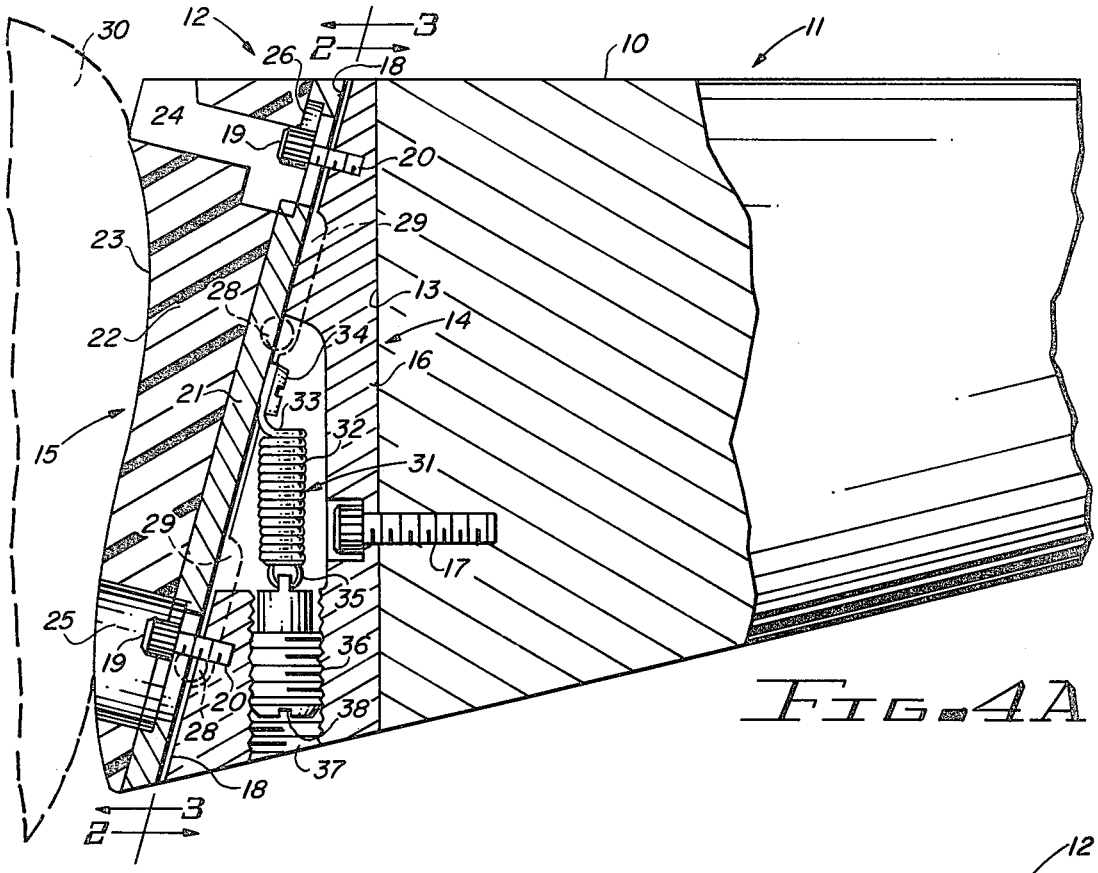
FIG. 4A is a partial view partially in cross-section of the recoil mechanism mounted at the butt end of the gun stock of the firearm taken along the line 4—4 in FIG. 1.
Figure 4B:
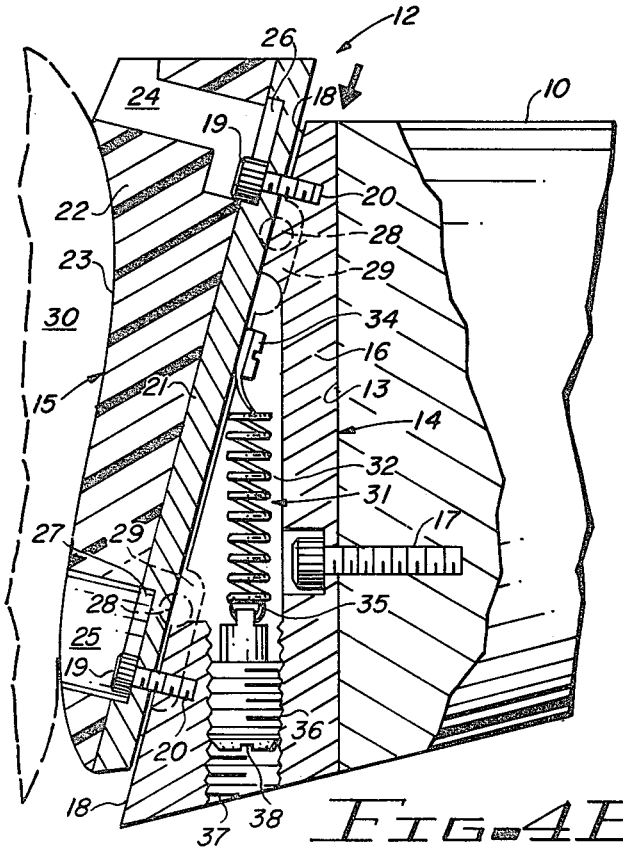
FIG. 4B is a view similar to FIG. 4A with the parts in their relative positions after absorption of the recoil.
Figure 7:
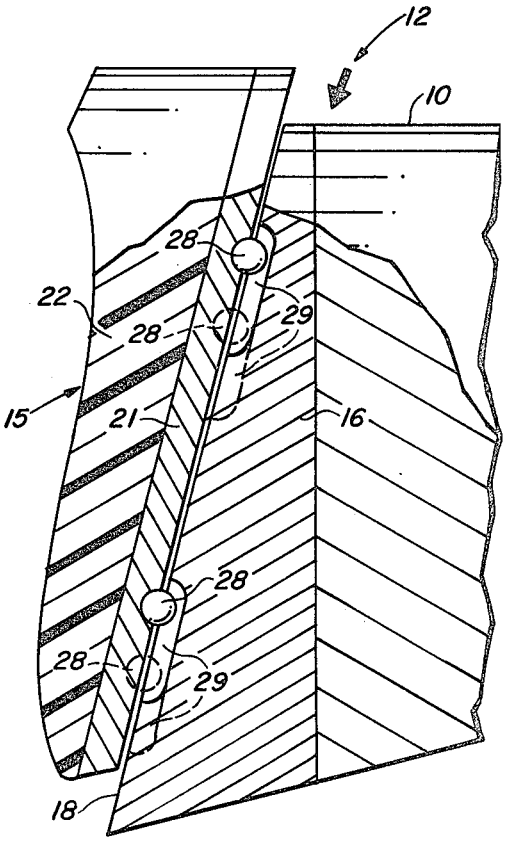
FIG. 7 is a cross-sectional view of FIG. 3 taken along the line 7—7.

Referring more particularly to the drawing by characters of reference, FIGS. 1, 4A and 4B disclose the outline of the gun stock end 10 of a standard rifle or shotgun 11 with the usual barrel, magazine and trigger not shown for simplicity purposes. The details of operation of the gun are not essential to the description of the particular invention, but in general, the firearm or gun may be a single shot or a rapid firing, relatively high powered firearm. In the design shown, the stock of the gun may be formed of a molded plastic although it can be formed of any other suitable material such as solid wood.

A recoil mechanism 12 is attached to the gun butt end 13 and comprises two relatively movable members 14 and 15 constructed and connected so that one member may be moved laterally of the other under the forces of recoil.

Member 14 comprises a base plate 16 which is secured to the butt end 13 of the gun stock 10 by suitable means such as a screw or bolt 17 which passes through an opening formed in the base plate 16 and into the gun stock.

The free end of the base plate is provided with a key or slide plate surface 18 from which protrudes the heads 19 of a pair of spacedly positioned bolts 20.

Mounted to form a slide plate surface along which the slide plate surface 18 may move thereover is the second member 15 of the recoil mechanism 12. This second member 15 comprises a face plate 21 supporting a foam or resilient pad 22 which is form fitted along its surface 23 to fit the shoulder of a user. The pad 22 and face plate 21 are provided with openings 24 and 25 which open into suitable blind sockets or openings 26 and 27, respectively, in the face plate 21. The bolts 20 are threaded into suitable apertures in base plate 16 with their heads 19 loosely fitting one over each of the openings into the sockets 26 and 27. The heads are of a diameter larger than the width of the sockets 26 and 27 thereby holding members 14 and 15 together in a relatively movable arrangement.

In order to move member 14 laterally of member 15 toward the feet of the gunner under recoil forces, two or more ball bearings 28 are arranged in two or more races 29 as shown in FIGS. 2, 3, 4A and 4B. Since the pad part 22 of the second member 15 of the recoil mechanism is held relatively fixed on the curvature of the shoulder 30 of the user of the firearm, the first part 14 moves relative thereto on recoil with the ball bearings 28 in their races 29 reducing the sliding friction of the moving parts.

Except during the effects of the forces of recoil, the parts 14 and 15 are held in juxtapositioned relationship by any suitable biasing means such as, for example, the spring biasing means 31 shown in FIGS. 4A and 4B. As shown in these figures part 14 of the recoil mechanism 12 is held juxtapositioned to part 15 thereof by a coil spring 32 secured at one end 33 by a bolt 34 to the face plate 21 of part 15 and at the other end 35 to a bolt 36 threadedly positioned in a suitable bore 37 in the base of part 14. Bore 37 is open ended so that a screwdriver or suitable tool (not shown) can be inserted into a slot 38 in the head of the bolt 36 for relative adjustment of it in the bore 37 to increase or decrease the tension on coil spring 32.

Figure 5:
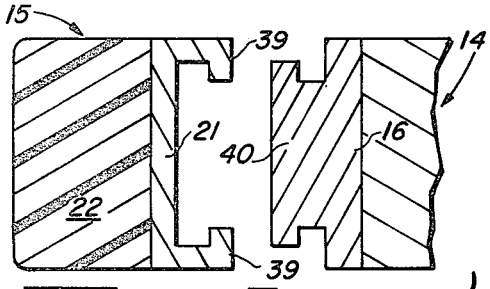
FIG. 5 is a cross-sectional view of a modification of the track means guiding the relatively movable parts of the recoil mechanism.
Figure 6:
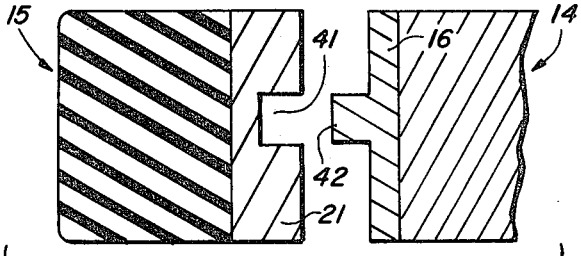
FIG. 6 is a cross-sectional view of a further modification of the track means guiding the relatively movable parts of the recoil mechanism shown in FIGS. 1–5.

FIGS. 5 and 6 illustrate modification of the structure shown in FIGS. 1–4 wherein the relative parts of the recoil mechanism 12 may be modified to form a track for guiding the movement of its parts relative to each other. In FIG. 5, member 15 may be provided with a flange 39 along the edges of face plate 21 to hold within its flanges an interlocking T-shape protrusion 40 mounted on the juxtapositioned surface of base plate 16 of member 14 of the recoil mechanism.

FIG. 6 illustrates that the guiding portion of the recoil mechanism may comprise a slot 41 in face plate 21 of member 15 in which a protrusion 42 of base plate 16 extends.

Figure 8:
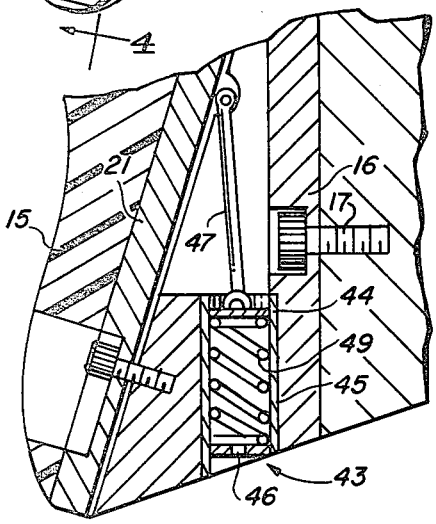
FIG. 8 is a further modification of the biasing means shown in FIGS. 1–7 wherein a pneumatic means is shown for absorbing recoil.
Figure 2:
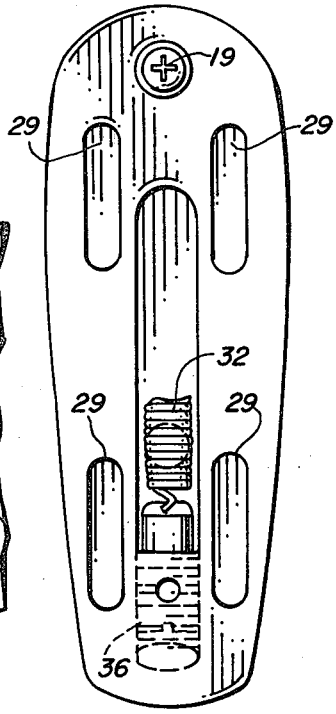
FIG. 2 is a cross-sectional view of FIG. 4A taken along the line 2—2.
Figure 3:
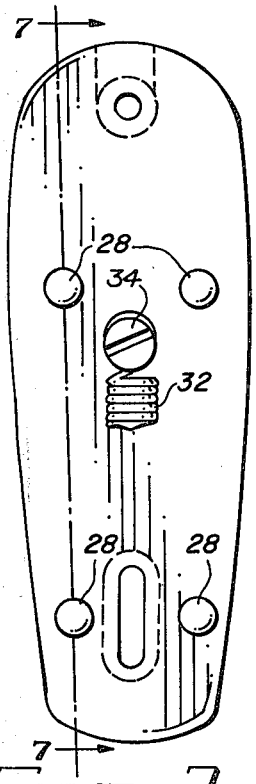
FIG. 3 is a cross-sectional view of FIG. 4A taken along the line 3—3.

FIG. 8 illustrates a further modification of the biasing means shown in FIGS. 1–7 wherein a pneumatic device 43 is used to absorb the recoil of the firearm. The pneumatic device comprises a piston 44 mounted in a cylinder 45 that is provided with a port 46 at one end thereof. As the piston is moved under the recoil forces its piston rod 47 pivotally attached to piston 44 causes reciprocal action of the piston 44 in cylinder 45 in the manner of a shock absorber. A coil spring 49 causes relative movement of members 14 and 15 of the recoil mechanism after absorption of the recoil forces to return members 14 and 15 to their normal at rest position.

Although but a few embodiments of the invention have been illustrated and described, it will be apparent to those skilled in the art that various changes and modifications may be made therein without departing from the spirit of the invention or from the scope of the appended claims.

I claim:

1. A recoil absorber and redirector mechanism for a shoulder held gun stock comprising:

a first member arranged to be rigidly affixed to the rear end of a gun stock, a second member attached to said first member and adapted for supporting the gun stock against the shoulder of a user, said first and second members being slidably movable laterally of each other, and dual purpose means interconnecting said first and second members for normally biasing them to a given aligned position and under recoil of the gun on which they are affixed resiliently resisting their relative movement caused by recoil, thereby absorbing at least a part of the recoil energy.

2. The recoil absorber and redirector mechanism set forth in claim 1 wherein:

said first and second members are provided with abutting sliding surfaces arranged laterally to the longitudinal axes of said first and second members, said sliding surfaces distorting the effects of recoil from a direction longitudinally of the gun stock to a direction laterally thereof.

3. The recoil absorber and redirector mechanism set forth in claim 2 wherein:

said sliding surfaces extend laterally from a point on the top of the gun stock across its width toward the shoulder of the user so as to distort at least a component of the recoil energy laterally of the gun stock and downwardly away from the head of the user.

4. The recoil absorber and redirector mechanism set forth in claim 2 wherein:

said dual purpose means comprises a spring.

5. The recoil absorber and redirector mechanism set forth in claim 2 wherein:

said dual purpose means comprises a pneumatic means.

6. The recoil absorber and redirector mechanism set forth in claim 2 wherein:

said dual purpose means is mounted within said first member.

7. The recoil absorber and redirector mechanism set forth in claim 2 wherein:

said first and second members comprise abutting sliding surfaces which extend laterally of their longitudinal axes.

8. The recoil absorber and redirector mechanism set forth in claim 2 wherein:

said first member moves relative to said second member under recoil of the firearm on which they are mounted.

9. The recoil absorber and redirector mechanism set forth in claim 2 wherein:

said first and second members each comprise abutting face plates which slidingly move one relative to the other under impact, and said second member comprises a resilient pad for formfitting the shoulder of a user.

10. The recoil absorber and redirector mechanism set forth in claim 3 in further combination with:

ball bearing means mounted between said sliding surfaces to aid their movement one relative to the other.

11. The recoil absorber and redirector mechanism set forth in claim 3 wherein:

said sliding surfaces are provided with interlocking means for maintaining said surfaces in a sliding relationship.

12. The recoil absorber and redirector mechanism set forth in claim 11 wherein:

said interlocking means comprises flanges arranged along the edge of one of said sliding surfaces for maintaining the other sliding surface juxtapositioned to it.

13. The recoil absorber and redirector mechanism set forth in claim 11 wherein:

said interlocking means comprises a protrusion extending outwardly of one of said sliding surfaces extending into a cooperating groove in the other of said sliding surfaces.

* * * * *